US005599045A

United States Patent [19]

Asai et al.

[11] Patent Number: 5,599,045

[45] Date of Patent: Feb. 4, 1997

[54] BOOK-BINDING STRUCTURE

[76] Inventors: Kiyomu Asai, 2-402, 30, Mitsuiminamimachi, Neyagawa-shi, Osaka, Japan; Kaoru Kaji, 18-12, Tanimachi 6-chome, Chuo-ku, Osaka, Japan

[21] Appl. No.: 601,844

[22] Filed: Feb. 15, 1996

Related U.S. Application Data

[63] Continuation of Ser. No. 288,613, Aug. 10, 1994, abandoned.

[51] Int. Cl.[6] ..... B42D 1/00

[52] U.S. Cl. ..... 281/21.1; 412/37

[58] Field of Search ..... 283/2–4; 281/21.1, 281/36, 15.1; 412/8, 9, 18, 33, 35, 38, 37

[56] References Cited

U.S. PATENT DOCUMENTS

| | | | |
|---|---|---|---|
| 2,263,528 | 11/1941 | Wissman | 283/2 |
| 4,184,218 | 1/1980 | Hawkes | 412/902 X |
| 5,013,200 | 5/1991 | Hunder et al. | 281/21.1 X |
| 5,129,772 | 7/1992 | Slautterback | 412/37 |
| 5,219,453 | 6/1993 | Furukawa et al. | 412/902 X |
| 5,413,381 | 5/1995 | Beeuwkes et al. | 281/21.1 |

*Primary Examiner*—Willmon Fridie, Jr.

*Attorney, Agent, or Firm*—Wenderoth, Lind & Ponack

[57] ABSTRACT

A relatively small number of sheets of paper are bound together into a calendar or the like. A plurality of through-holes are formed in the sheets of paper near the top edges thereof. The through-holes in each sheet are aligned with the through-holes in the other sheets. An adhesive is poured into the through-holes to bind the sheets of paper together.

2 Claims, 3 Drawing Sheets

BOOK-BINDING STRUCTURE

This application is a Continuation of now abandoned application Ser. No. 08/288,613, filed Aug. 10, 1994.

BACKGROUND OF THE INVENTION

This invention relates to a book-binding structure in which a relatively small number of sheets of printed material are bound to form an article such as a calendar.

A book type of calendar is made up of a relatively small number (e.g. seven or 13 including the cover) of sheets of paper.

Thus, when forming a book type of calendar, it is impossible to securely bind such a small number of sheets by what is known as "back gluing". The sheets of paper had to be bound together with a metal binder attached to the top edges of the sheets.

New year's calendars become practically worthless some time after the new year has begun. Thus, manufacturers of such book type calendars have to dispose of a vast number of calendars at the beginning of every year.

If the sheets of paper forming such book type calendars can be recycled instead of disposing of them, it is possible to greatly save paper resources.

In order to recycle the sheets of paper forming book type calendars, the metal binders used to bind the top edges of the sheets have to be removed.

However since it takes a lot of time and money to remove such metal binders from each and every book type of calendar, such calendars were heretofore disposed of by burning. Precious paper resources were thus wasted to ashes.

Metal binders also have the drawback that when people handle them carelessly, they may hurt their hands.

SUMMARY OF THE INVENTION

It is an object of this invention to provide a book-binding structure which can securely bind even a relatively small number of sheets of paper together without the need of a metal binder and which is safe to handle.

The book-binding structure for binding a plurality of sheets of paper according to this invention comprises a plurality of through holes formed in each of the sheets of paper along top edge thereof, the through holes in each sheet of paper being aligned with the through holes in the other sheets, and an adhesive poured into the through holes to bind the sheets of paper together.

When the adhesive poured into the through holes formed in the sheets hardens, it will act like support pillars, thus securely binding the sheets of paper together.

According to this invention, even a relatively small number of sheets of paper can be bound together into a book type of calender or the like without using a metal binder.

Since no metal binder is used, the sheets of paper forming calendars or the like are recyclable. Thus, it is possible to save a great deal of paper resources.

Also, because of the book-binding structure has no metal binder it is safe to handle.

BRIEF DESCRIPTION OF THE DRAWINGS

Other features and objects of the present invention will become apparent from the following description made with reference to the accompanying drawings, in which.

DETAILED DESCRIPTION OF THE PREFERRED EMBODIMENT

FIGS. 1–4 show one embodiment of this invention.

Figure 1:
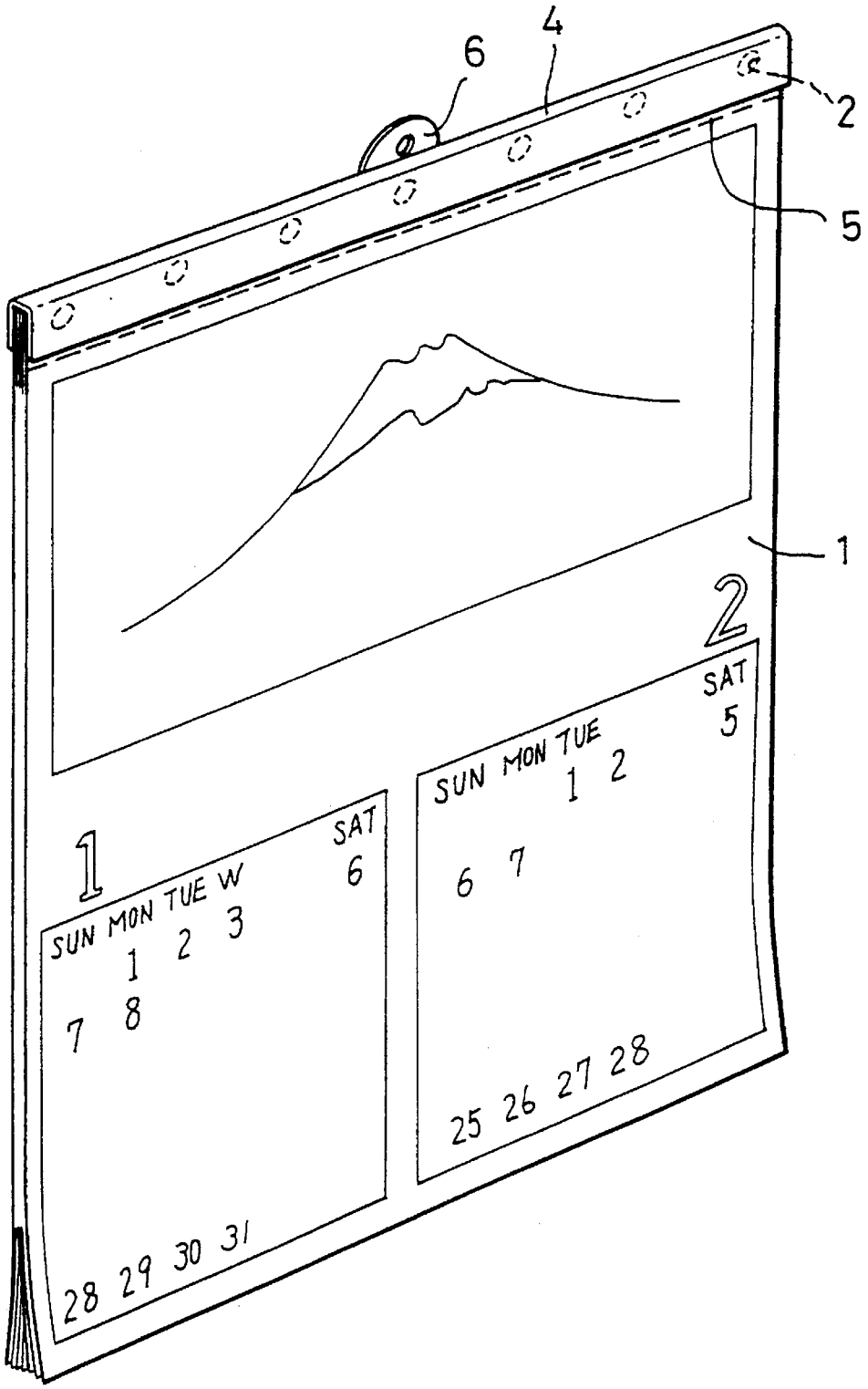
FIG. 1 is a perspective view of a book type of calender having the book-binding structure according to this invention.
Figure 2:
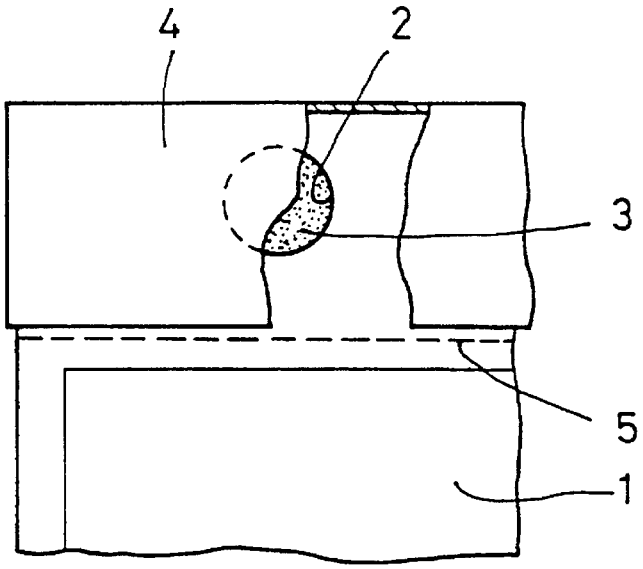
FIG. 2 is a front view of part of the same.
Figure 3:
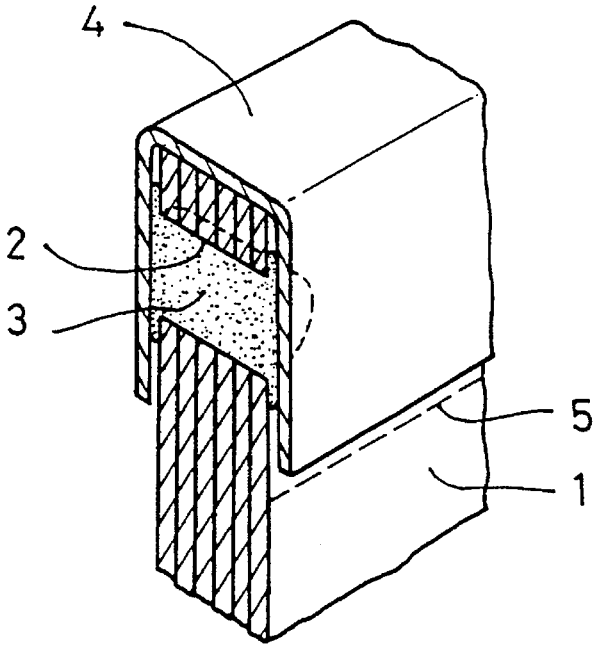
FIG. 3 is a perspective view of part of the same.
Figure 4:
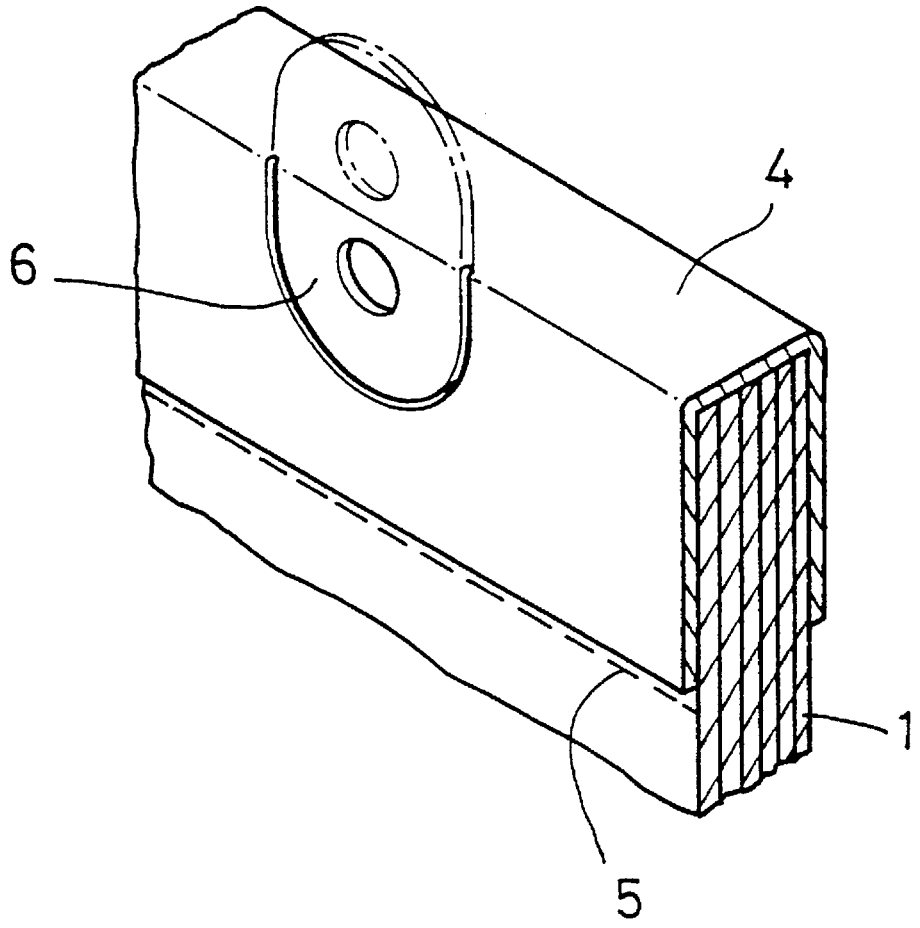
FIG. 4 is a partial vertical sectional perspective view of part of the same as seen from back.

FIG. 1 shows a book type of calendar comprising six sheets of paper 1 bound together. Each sheet 1 is formed along its top edge with a plurality of through holes 2 that are aligned with the holes 2 formed in the other sheets 1. According to the present invention, the sheets 1 are bound together by pouring an adhesive 3 into the holes 2.

The adhesive 3 may be a hot-melt type of thermoplastic resin adhesive.

A back cover 4, made of cardboard or the like, is applied around the top edges of the six sheets 1 thus bound together and is bonded to them. The adhesive 3 may be poured into the holes 2 in such an amount that it will partially overflow from the holes 2 on both sides. Thus, the back cover 4 can be bonded to the sheets with the adhesive that has overflowed from the holes 2. Alternatively, the back cover 4 may be glued to the sheets with an adhesive other than the adhesive poured into the holes 2 or bonded thereto through a double-sided adhesive tape.

Each sheet 1 has perforations 5 as a tear-off line near its top edge.

On the back of the back cover 4 is provided a hook 6 for hanging the calendar, which is formed by cutting and raising a part of the back cover 4.

What is claimed is:

1. A book-binding structure comprising: a plurality of superposed sheets of paper each having a top edge and a plurality of through-holes extending through the sheet from a front surface of the sheet to a rear surface of the sheet, said through-holes in each of said sheets of paper being spaced from one another along the top edge of the sheet, and said through-holes in each of said sheets of paper being aligned with the through-holes in the other said sheets in a direction perpendicular to the front and rear surfaces of the sheets; adhesive more than completely filling said through-holes such that said adhesive at least partially overflows from opposite ends of each set of aligned ones of said through-holes; and a back cover covering said through-holes, said sheets being bonded together by said adhesive, and said back cover being bonded to said sheets at the top edges of said sheets by said adhesive which at least partially overflows.

2. A book-binding structure as claimed in claim 1, wherein said adhesive occupying said through-holes bonds said back cover to said sheets.

* * * * *